US011919669B2

(12) United States Patent
Boulais

(10) Patent No.: US 11,919,669 B2
(45) Date of Patent: Mar. 5, 2024

(54) METHOD FOR MANUFACTURING A DEVICE FOR DISPENSING A PRODUCT

(71) Applicant: GB DEVELOPPEMENT, Vernon (FR)

(72) Inventor: Guillaume Boulais, Levallois Perret (FR)

(73) Assignee: GB DEVELOPPEMENT, Vernon (FR)

( * ) Notice: Subject to any disclaimer, the term of this patent is extended or adjusted under 35 U.S.C. 154(b) by 393 days.

(21) Appl. No.: 17/290,831

(22) PCT Filed: Oct. 4, 2019

(86) PCT No.: PCT/EP2019/076978

§ 371 (c)(1),
(2) Date: May 3, 2021

(87) PCT Pub. No.: WO2020/094304

PCT Pub. Date: May 14, 2020

(65) Prior Publication Data

US 2021/0371134 A1 Dec. 2, 2021

(30) Foreign Application Priority Data

Nov. 9, 2018 (FR) ..... 1871476

(51) Int. Cl.
*B65B 3/10* (2006.01)
*B65B 3/00* (2006.01)
(Continued)

(52) U.S. Cl.
CPC ..... *B65B 3/12* (2013.01); *B65B 3/003* (2013.01); *B65B 3/18* (2013.01)

(58) Field of Classification Search
CPC .. B65B 3/12; B65B 3/18; B65B 3/003; B05B 11/0097; B05B 11/1032; B05B 11/028
See application file for complete search history.

(56) References Cited

U.S. PATENT DOCUMENTS 4,750,532 A 6/1988 Grothoff
2008/0118299 A1* 5/2008 Py ..... B05B 11/0097
(Continued)

FOREIGN PATENT DOCUMENTS

FR 2969935 A1 7/2012
WO 2008/061041 A1 5/2008
(Continued)

OTHER PUBLICATIONS

International Search Report for corresponding Application No. PCT/EP2019/076978, dated Jan. 22, 2020.

*Primary Examiner* — Thomas M Wittenschlaeger
(74) *Attorney, Agent, or Firm* — Renner, Otto, Boisselle & Sklar, LLP

(57) ABSTRACT

A method for manufacturing a device for dispensing a product, including a supply of a device having a reservoir, the reservoir being connected to a deformable chamber and being provided with a filling opening, the interior of the deformable chamber being delimited at least in part by a movable wall, a displacement of which causes a variation in the volume of the deformable chamber, a step of filling of the chamber deformable through a filling valve, a step of filling of the reservoir with product, and a closing step in which the filling opening is closed. Application includes, for example, the pharmaceutical or cosmetic or agro-food industry.

9 Claims, 4 Drawing Sheets

(51) Int. Cl.
*B65B 3/12* (2006.01)
*B65B 3/18* (2006.01)

(56) References Cited

U.S. PATENT DOCUMENTS

| | | | |
|---|---|---|---|
| 2014/0124541 | A1 | 5/2014 | Mathiez |
| 2017/0021375 | A1 | 1/2017 | Boulais |

FOREIGN PATENT DOCUMENTS

| | | | |
|---|---|---|---|
| WO | 2009/141510 | A1 | 11/2009 |
| WO | 2015/155318 | A1 | 10/2015 |

* cited by examiner

METHOD FOR MANUFACTURING A DEVICE FOR DISPENSING A PRODUCT

TECHNICAL FIELD

The present invention relates to a method for manufacturing a device for dispensing a product.

The field of the invention is more particularly that of the distribution of products such as liquids, gels or creams, for example for the pharmaceutical or cosmetic or agro-food industry.

STATE OF THE ART

Fluid dispensers are known, such as disclosed for example by PCT Publication WO2015155318. Such a device comprises:

- a deformable chamber,
- a reservoir,
- a dispensing valve for the exit of the product from the chamber toward the outside of the device, and
- a feed valve for the passage of the product from the reservoir toward the deformable chamber.

This device, although good, may still be improved because this device still poses some technical problems.

A first problem is that of difficulty priming the chamber, which is when the chamber is filled with air when the device is new, and a user presses on the chamber so as to pump the product from the reservoir trying to fill the chamber.

A second problem is the use of part of the volume of the reservoir to fill a dead zone of the deformable chamber when the rate of deformation of the deformable chamber relative to its total volume is low.

The aim of the present invention is to provide a method for manufacturing a device for dispensing a product that solves or improves these problems.

DISCLOSURE OF THE INVENTION

The object of the invention is achieved with a method for manufacturing a device for dispensing a product, comprising:

- a supply of a device having a deformable chamber (and preferably a reservoir, said reservoir being connected to the deformable chamber and being provided with a filling opening), the interior of the deformable chamber being delimited at least in part by a movable wall of which displacement causes a variation of the volume of the deformable chamber and:
  - being separated from the reservoir (if present) at least by a feed valve, and/or
  - being separated from an outlet of the device at least by a dispensing valve, and/or
  - being separated from the reservoir (if present) or from the outside of the device by a filling valve and/or,
- a step:
  - of filling with product at least part of the deformable chamber through the filling valve and/or
  - of filling at least partial with product, preferably within a channel, so that the product is in contact with the filling valve on the side of the reservoir (if present) and/or on the side of the chamber deformable,
- and preferably a closing step in which the filling opening is closed.

According to different embodiments the following features may be present.

The method according to the invention may comprise the step of filling the deformable chamber, then the step of filling the reservoir, then a step of "rotating" the deformable chamber relative to the reservoir before an assembly of the deformable chamber and the reservoir so as to form the device, and implementing the step of supplying the device; and a closing step is preferably carried out during the assembly of the deformable chamber and the reservoir.

The method according to the invention may be a method for manufacturing a device for dispensing a product, comprising:

- providing a device comprising a reservoir, said reservoir being connected to a deformable chamber and being provided with a filling opening, the interior of the deformable chamber being delimited at least in part by a movable wall, a movement of which causes a variation of the volume of the deformable chamber, the device comprising an outlet, the interior of the chamber is separated from the reservoir by at least one filling valve and separated from the outlet of the device at least by one dispensing valve, then
- filling the deformable chamber, and
- performing a closing step in which the filling opening is sealed or closed.

During the filling step, the method may be performed so that a filling pipe presses the filling valve.

During the filling step, the device may be performed so that the filling pipe enters the deformable chamber.

The method may be performed so that the filling pipe of the deformable chamber is a thinner pipe than the filling pipe of the reservoir.

During the filling step of the deformable chamber, gas initially contained in the deformable chamber may exit through the filling orifice.

The device according to the invention may be arranged so that the filling valve is merged with the valve as the feed valve of the deformable chamber.

The method according to the invention may further comprise an evacuation step in which a depression is created in a deformable chamber with respect to an atmospheric pressure, in order to bring additional product from the reservoir to the interior of the deformable chamber.

The filling valve may be placed between the reservoir and the deformable chamber.

The filling valve may be merged with the feed valve.

The method according to the invention may comprise:

- the filling step of the deformable chamber,
- the filling step of the reservoir, and
- then:
- an assembly of the deformable chamber and the reservoir so as to form the device, and implementing the device supply step.

The closing step may be performed during the assembly of the deformable chamber and the reservoir.

The method according to the invention may comprise, before the closing step, a "rotation" step in which the deformable chamber and/or the reservoir is rotated so as to assemble the deformable chamber with the reservoir.

The method according to the invention may include means for moving at least part of the filling valve towards the interior of the deformable chamber so as to open the deformable chamber; i.e. an opening of the deformable chamber by may be formed by the means for moving at least part of the filling valve towards the interior of the deformable chamber.

During filling, gas initially inside the deformable chamber may exit the deformable chamber through the filling orifice.

The method according to the invention may comprise providing a filling pipe of the chamber arranged to enter the interior of the deformable chamber, the method preferably comprising a utilization of the filling pipe of the chamber, preferably to open the filling valve, and fill at least partially the chamber with the product circulating in the filling pipe of the chamber.

The method according to the invention may further comprise providing a filling pipe of the reservoir, the cross section of which at its end is at least twice as large as the cross section of the filling pipe of the deformable chamber at its end, the method comprising preferably a utilization of the filling pipe of the reservoir to fill, preferably through the filling opening, the reservoir with product circulating in the filling pipe of the reservoir.

The method according to the invention may comprise an additional step of evacuating the deformable chamber, and then a step of closing the reservoir to bring additional product into the deformable chamber from the reservoir.

The method according to the invention may comprise:

a step of assembling the deformable chamber to a ring by passing the deformable chamber through the inside of the ring, so that the ring surrounds the chamber while leaving an insertion orifice for the dispensing valve accessible, then a step of assembling the dispensing valve to the deformable chamber by inserting the dispensing valve into the insertion orifice of the dispensing valve; and the method according to the invention may further comprise a step of assembling the deformable chamber on the reservoir by the ring so that the ring is fixed to the reservoir.

The filling step may be a step of at least partial filling of priming product, so that the priming product is in contact with the filling valve (or with the feed valve, respectively) on the side of the reservoir and/or on the side of the deformable chamber, so that the priming product comprises a gel or a liquid between a movable membrane of the filling valve (or of the feed valve, respectively) and a seat of the filling valve (or of the feed valve, respectively) while the chamber is at least partially filled with gas or only gas.

BRIEF DESCRIPTION OF THE DRAWINGS

Other advantages and particularities of the invention will appear on reading the detailed description of implementations and non-limiting embodiments, and the following appended drawings.

DETAILED DESCRIPTION

As these embodiments are in no way limitative, it is possible in particular to consider variants of the invention comprising only a selection of characteristics described or illustrated below in isolation from the other characteristics described or illustrated (even if this selection is isolated within a sentence comprising these other characteristics), if this selection of characteristics is sufficient to confer a technical advantage or to differentiate the invention with respect to the state of the art. This selection comprises at least one preferably functional characteristic without structural details, and/or with only a part of the structural details if this part alone is sufficient to confer a technical advantage or to differentiate the invention with respect to the state of the art.

Figure 1:
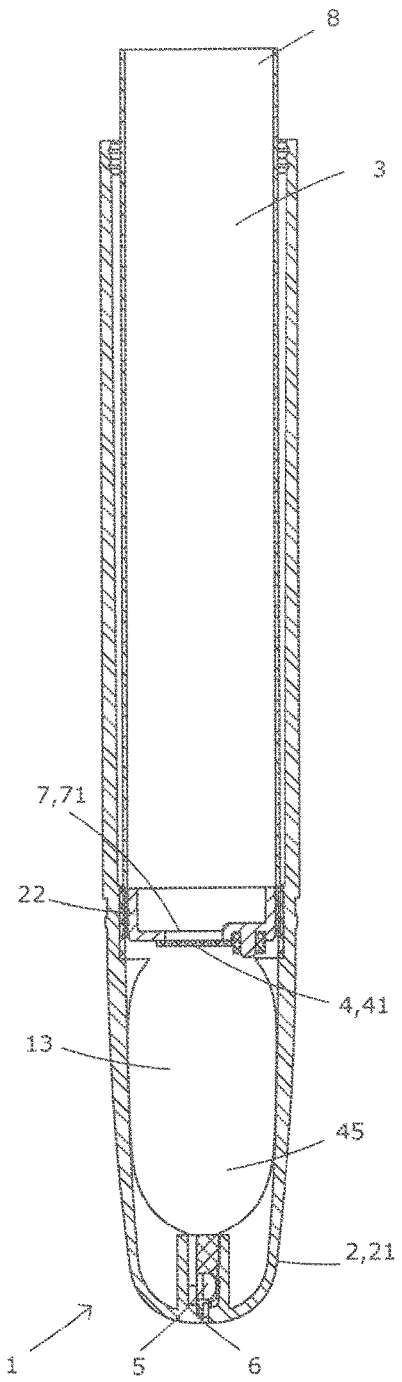
FIG. 1 is a side sectional view illustrating an initial step according to a first embodiment of a method for manufacturing a device 1.
Figure 2:
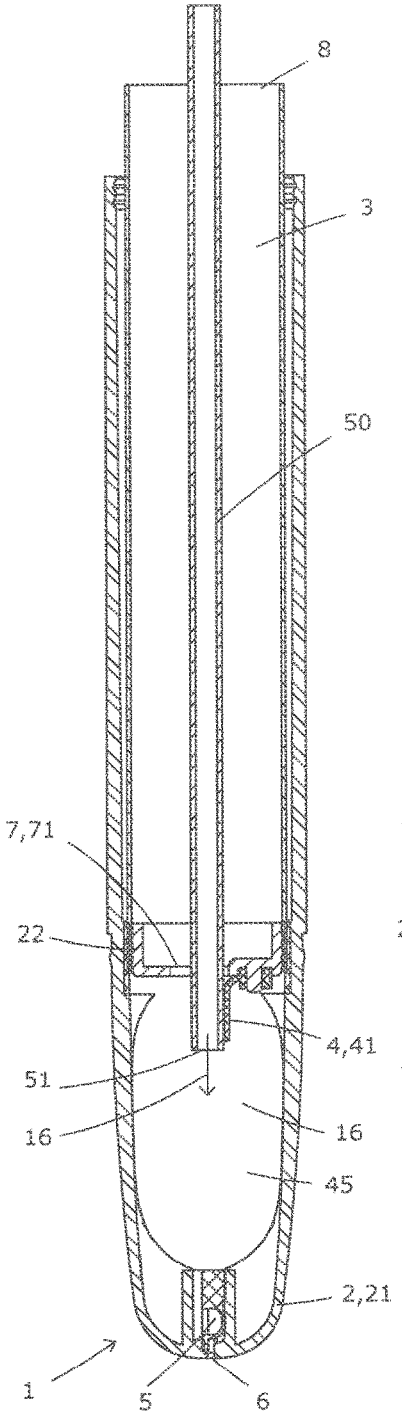
FIG. 2 is a side sectional view illustrating a step of filling the deformable chamber according to the first embodiment of the method.
Figure 3:
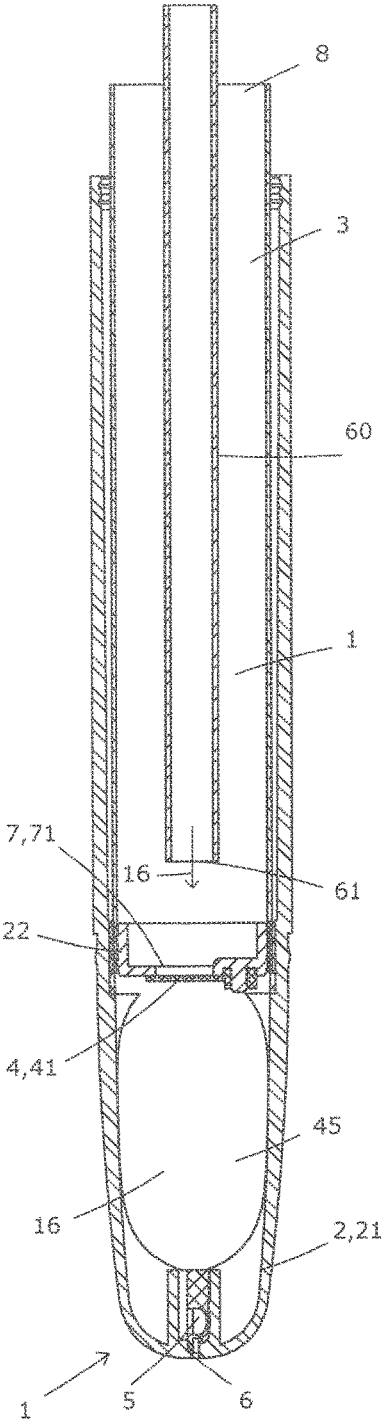
FIG. 3 is a side sectional view illustrating a step of filling the reservoir according to the first embodiment of the method.

First described, with reference to FIGS. 1 to 3, is the first embodiment of the method according to the invention for manufacturing a device 1 dispensing a product 16.

The various technical means described for implementing this method constitute the manufacturing system 10 according to the invention.

Figure 9:
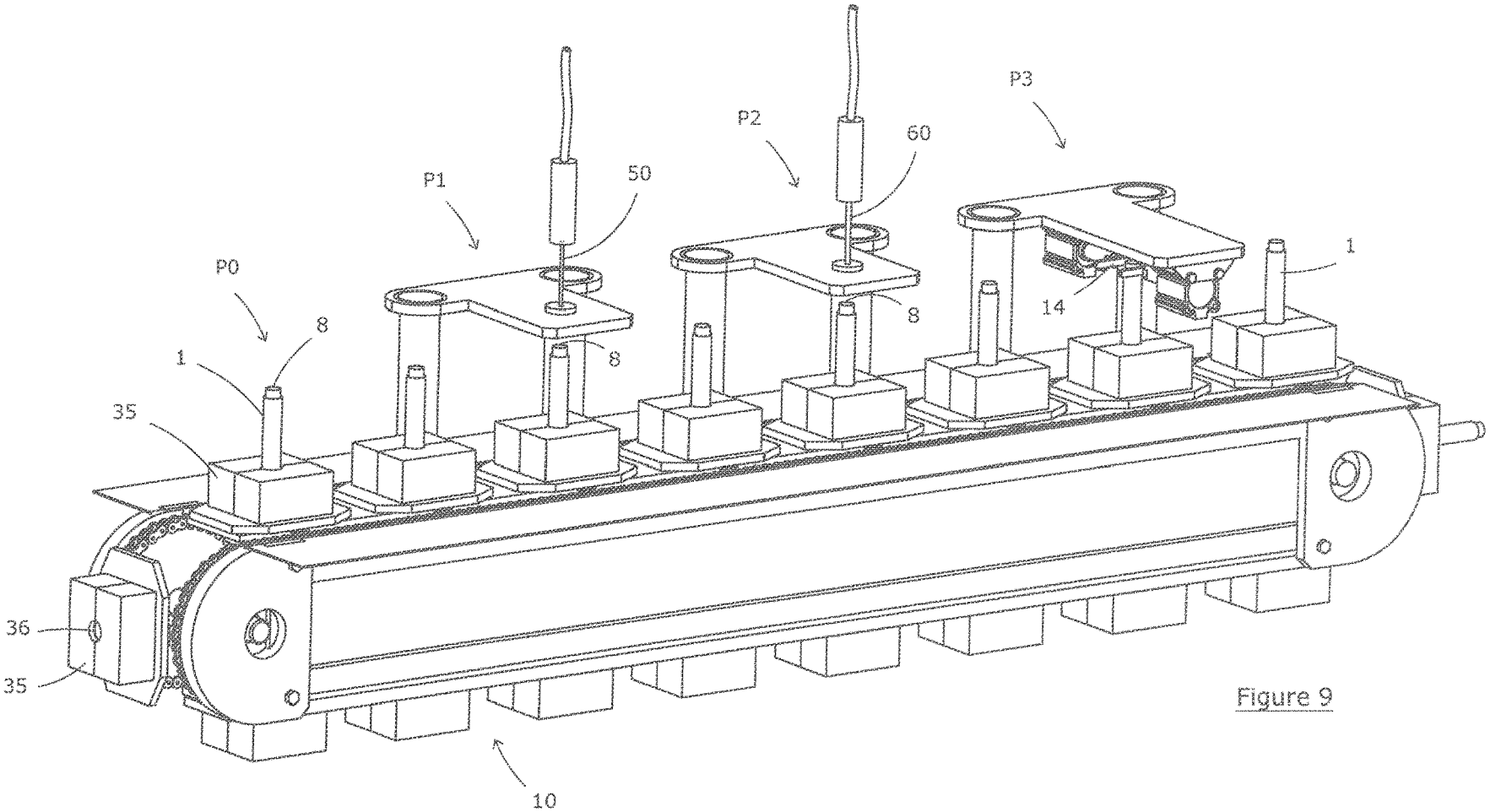
FIG. 9 is a perspective view of a system or an installation 10 for implementing the method according to the first embodiment.

The initial step of this method illustrated in FIGS. 1 and 9 is a step of providing a device 1 comprising a reservoir 3 and a head 2.

The head 2 comprises a cap 21 provided with at least one flexible part closed by a stopper 22 forming a deformable chamber 45 with the cap 21.

The chamber 45 is separated from the reservoir 3 at least by a feed valve 4 connected to a feed orifice 7. The chamber 45 is separated from the outside of the device or from the reservoir by a filling valve 41 connected to a filling orifice 71. The filling valve allows the deformable chamber 45 to be filled and is arranged to open when one presses on it and to close when one does not press on it, or more generally to open under the effect of an overpressure, for example an overpressure of product 16, and to close again when there is no longer any overpressure. Note that the feed valve opens when pressed and closes when not pressed. In a preferred embodiment of the invention, the filling valve 41 is merged with or is with the feed valve.

The device comprises an outlet 6 separated from the deformable chamber 45 by a dispensing valve 5.

The reservoir is flexible and is formed by a flexible film or an extruded tube typically made of polyethylene comprising a layer, which may be provided with other layers, forming a barrier to gases and/or to light.

The reservoir 3 is provided with a filling opening 8 and is fixed on the head 2, and the reservoir 3 communicates with the deformable chamber 45 by means of the filling orifice 71 through a filling valve 41. It is noted on the drawings that the filling orifice 71 and the feed orifice 7 are merged, and likewise the filling valve 41 and the feed valve 4 are merged. However, in another embodiment, not shown, the device according to the invention is arranged so that the filling valve 41 and the feed valve 4 are separated, and in this case the feed orifices 7 and 71 may or may not be separated.

During this initial supply step, the device is preferably at atmospheric pressure, the device arrives at station p0.

The filling opening 8 is a direct communication between the interior of the reservoir 3 and the exterior of the device 1.

The interior of the deformable chamber 45 is delimited at least in part by the wall 13, a displacement of which causes a variation in the volume of the deformable chamber 45.

During an initial step, device 1 is empty.

During this initial step, the reservoir 3 does not include the product 16, and is preferably filled only with gas, preferably air and/or an inert gas such as nitrogen.

During this initial step, the device 1 is in an initial state that is not closed, because the filling opening 8 is not yet closed.

The chamber 45 is separated from the reservoir 3 at least by the feed valve 4 and/or a filling valve 41. Preferably, the filling valve is placed between the reservoir 3 and the deformable chamber 45.

The filling valve 41 is arranged to open from outside the deformable chamber when pressed or more generally to open when it receives a pressure or overpressure, and to close when this pressure or overpressure disappears. In a preferred embodiment of the invention, the filling valve 41 and the feed valve 4 are merged, the device is arranged so that the filling valve 41 and the feed valve 4 are identical.

The feed and fill valve 4 is flexible, typically including a thermoplastic elastomer (TPE) or a thermoplastic polyurethane elastomer of 80 Shore A.

The chamber 45 is arranged so that a decrease in the volume of the chamber 45 (for example by pressing on the wall 13) closes the feed valve 4, at least when the chamber is filled (preferably completely) with the product 16 (which is not yet the case in this initial step).

The chamber 45 is arranged so that an increase in the volume of the chamber 45 (for example by releasing the wall 13) opens the feed valve 4, at least when the chamber is filled (preferably completely) with the product 16 (which is not yet the case in this initial step). It is noted that when the filling valve 41 is separated from the feed valve 4, it may remain closed during an increase in volume of the deformable chamber 45. In particular it is preferable that it remains closed during an increase of volume of the deformable chamber 45 if it is not in the reservoir 3. In one embodiment of the invention where the filling valve separates the chamber 45 from the outside of the device, the filling valve 41 may be arranged to be more rigid than the feed valve 4 in order to stop up the chamber 45 after filling, and in this case the filling valve 41 acts as a stopper.

The chamber 45 is separated from an outlet 6 of the device 1 at least by a dispensing valve 5.

The outlet 6 is arranged to dispense fluid in a direction substantially parallel to an axis of elongation of the head.

The dispensing valve 5 is flexible, typically including a thermoplastic elastomer (TPE) or a thermoplastic polyurethane elastomer of 80 Shore A.

The chamber 45 is arranged so that a decrease in the volume of the chamber 45 (for example by pressing on the wall 13) opens the dispensing valve 5, at least when the chamber 45 is filled (preferably completely) with the product 16 (which is not yet the case in this initial step).

The chamber 45 is arranged so that an increase in the volume of the chamber 45 (for example by releasing the wall 13) closes the dispensing valve 5, at least when the chamber 45 is filled (preferably completely) with the product 16 (which is not yet the case in this initial step).

When it is open, the feed valve 4 allows product to pass, typically from reservoir 3 to chamber 45. When it is closed, the feed valve 4 does not allow product to pass.

When it is open, the dispensing valve 5 allows product passage, typically from chamber 45 to outlet 6. When it is closed, the dispensing valve 5 does not allow such product passage.

The feed valve 4 comprises a membrane which, in the closed state of this feed valve 4, is pressed against the feed orifice so as to stop up this feed orifice, and in the open state of this feed valve 4 the membrane moves away from the feed orifice so as to open this feed orifice. the feed valve 4 is an independent part of the head 2, and is housed (at least its membrane) on the side of the chamber 45.

The feed valve 4 (movable between its closed and open positions) is, in its closed state, kept pressed against a part, preferably immobile, called a feed seat, which at least partially surrounds the periphery of the associated feed orifice, and is "rigid" (ie not made of flexible material), of an internal wall of the chamber 45. More specifically, the feed valve 4 comprises a movable membrane which, in the closed state of the feed valve 4, is kept pressed against the feed seat, and moves away from this feed seat in its open state.

The feed seat is located inside the chamber 45.

A dispensing orifice connects the chamber 45 to the dispensing duct.

The dispensing valve 5 is an independent part of the head 2 and is housed (entirely) inside the dispensing duct.

The dispensing valve 5 comprises a membrane which, in the closed state of this dispensing valve 5, is pressed against the dispensing orifice so as to stop up this dispensing orifice, and in the open state of this dispensing valve 5, the membrane moves away from the dispensing orifice so as to open this dispensing orifice.

The dispensing orifice is located on a side wall of the dispensing duct, so that the dispensing orifice, the dispensing duct and the dispensing valve 5 are arranged so that the product travels globally (that is to say on a scale larger than the swirls of the microparticles of the product 16) at a right angle or substantially a right angle passing from the chamber 45 to the dispensing duct, that is to say between the direction of propagation of the product at the inlet of the dispensing valve 5 and the direction of propagation of the product at the outlet of the dispensing valve 5.

The dispensing valve 5 (movable between its closed and open positions) is, in its closed state, kept pressed sufficiently firmly, by means of return means or a return spring of the valve 5, for example as described in the PCT Publication WO2015/155318 against a part. The part is stationary and called a dispensing seat, which at least partially surrounds the periphery of the associated dispensing orifice, and is "rigid" (ie not made of flexible material), of an internal wall of the dispensing duct in which it is housed. More specifically, the dispensing valve comprises a membrane which, in the closed state of the dispensing valve, is held pressed against the dispensing seat, and moves away from this dispensing seat in its open state. It is further noted that the dispensing seat is a lateral part of the dispensing duct, that is to say that this dispensing seat is limited to one face, preferably flat, of an internal wall of the dispensing duct and does not go all around a section of the dispensing duct which would be made in a plane perpendicular to the direction of elongation of the dispensing duct. The distribution seat is located outside of chamber 45.

FIG. 9 represents an installation 10 with a conveyance of several devices 1 or 102, wherein the head 2 is inserted in a cavity 36 of conveyor buckets 35.

Then, with reference to FIGS. 2 and 9, a filling station p1 comprises a filling pipe 50, in this first embodiment of the method according to the invention the device comprises a step in which the deformable chamber 45 is filled with product 16 at least in part by opening the filling valve 71 by direct pressure by the filling pipe 50. More specifically a filling pipe 50 passes through the reservoir 3, and then the filling orifice 71 and comes with its end 51 to press the filling valve 41 so as to open it and perform a filling through the filling valve 71. Thus this filling of the deformable chamber makes it possible to improve the priming, preferably at least 20% and even 50% of the volume of the deformable chamber is filled, preferably entirely.

Preferably the filling pipe 50 enters the deformable chamber 45. The filling pipe 50 is arranged to move the filling valve with its filling end 51 towards the interior of the deformable chamber 45 so as to open the deformable chamber 45. Under the pressure of the filling pipe at least part of the filling valve moves inside the deformable chamber 45. The deformable chamber 45 opens so that the gas initially contained in the deformable chamber 45 exits through filling orifice 71.

It is noted in FIG. 2 that the filling valve is the feed valve 4 of the device 1, and likewise the filling orifice is the feed orifice of the feed valve 4. The method is arranged to fill the chamber 45 through the feed valve 4.

The filling pipe pushes the valve sufficiently into the chamber 45 so that no part of the valve faces the outlet of the needle at its end 51. In another embodiment not shown it is preferable that the filling pipe 50 comprises an angled outlet so as to have a non-straight product outlet. Preferably, the filling valve 41 is flexible and comprises a movable part in the form of a tongue which faces the end 51, and comprises a part fixed to a lateral part of the stopper 22. After filling the deformable chamber 45, the withdrawal of the filling pipe 50 allows the deformable chamber to be closed by means of a shape memory of the filling valve 41.

Preferably the end 51 of the filling pipe 50 is thin having a cross section of less than 40 $mm^2$ to even less than 20 $mm^2$. The filling pipe 50 has a needle shape.

After the filling step of the deformable chamber 45, the step of filling the reservoir 3 is carried out as illustrated in FIG. 9 at station p2. However, if the volume of product to be filled in the reservoir 3 is small, the step of filling the deformable chamber and the step of filling the reservoir may be done on the same filling station therefore without moving the device 1, and the fillings 50 and 60 are identical.

For reasons of filling rate, it is preferable that the filling pipe 60 of the reservoir 3 is arranged to have a greater flow rate than the filling pipe 50. The cross section of the filling pipe 60 at its end 61 is at least 2 times larger than the section of the filling pipe 50 at its end 51.

Then, with reference to FIGS. 3 and 9, the first embodiment of the method according to the invention comprises a closing step in which the filling opening 8 shown at station p3 is sealed or closed.

The closure is carried out for example by means of a clamp 14 for ultrasonic welding or hot welding.

Next described, with reference to FIGS. 4 to 8, is a second embodiment of the method according to the invention of manufacturing a device 102 for dispensing product.

This second embodiment will only be described for its differences from the first embodiment of the method according to the invention, and all the numerical references already described above will therefore not necessarily be described again.

Figure 4:
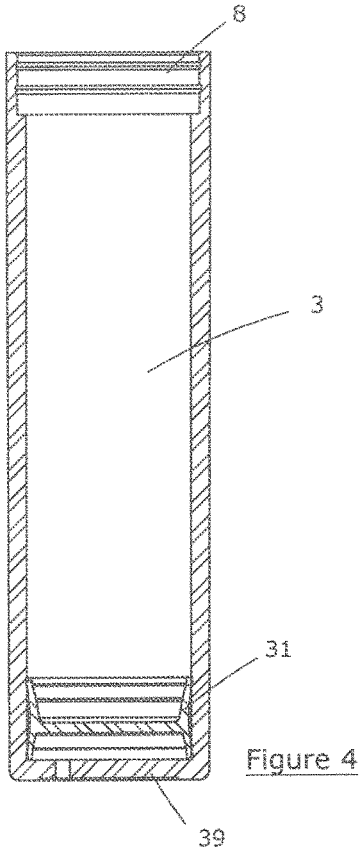
FIG. 4 is a side sectional view illustrating an initial step of providing the reservoir of the device according to a second embodiment of a method for manufacturing a device 102.
Figure 5:
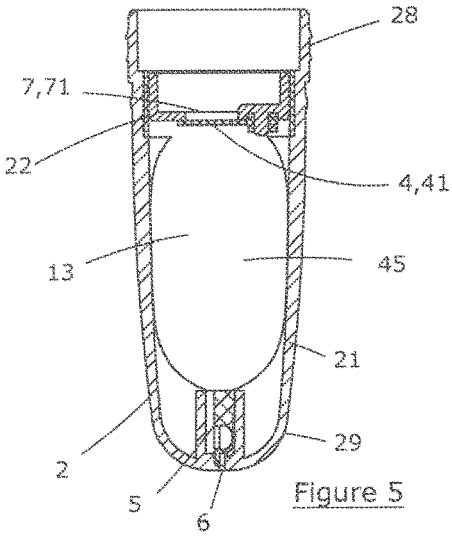
FIG. 5 is a side sectional view illustrating an initial step of providing the head of the device according to the second embodiment of the method.

Referring to FIGS. 4 and 5, in this second embodiment, the initial step of this method illustrated in FIGS. 4 and 5 is a step of providing a device 102 comprising a reservoir 3 and a head 2, and the head 2 and reservoir 3 are supplied separately. The reservoir 3 is deformable but comprises rigid plastic walls formed by a piston and a hollow cylinder, and it comprises a bottom 39. The head 2 comprises an open end 28, which is assembled with the reservoir 3 at the level of the opening 8, and one end 29 towards the outlet. The device is placed in the installation (not shown in the figures) with the bottom 39 of the reservoir and the end 29 of the head towards the ground, and therefore the opening 8 of the reservoir and the open end 28 of the head up in the installation.

Figure 6:
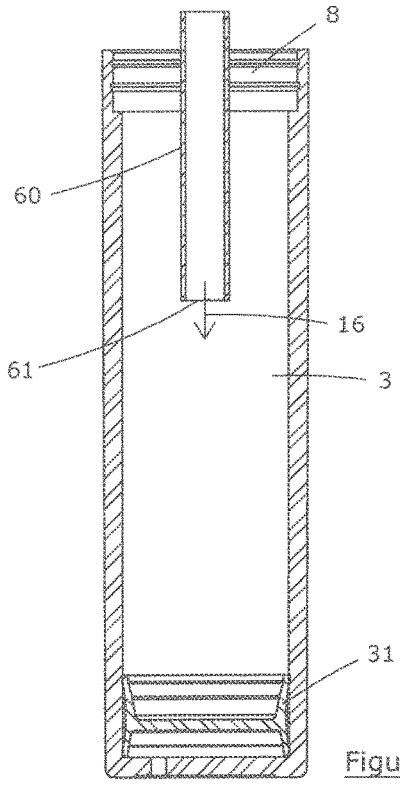
FIG. 6 is a side sectional view illustrating a step of filling the deformable chamber according to the second embodiment of the method.
Figure 7:
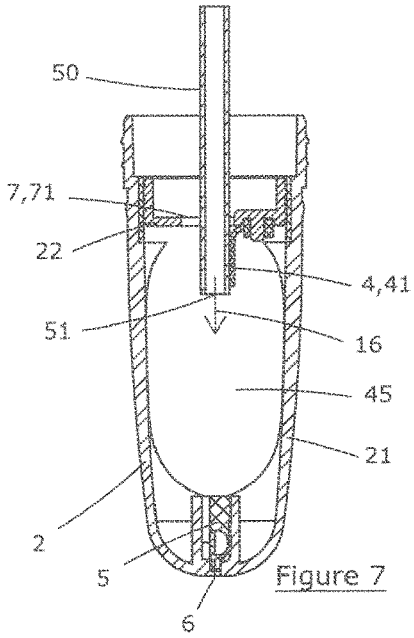
FIG. 7 is a side sectional view illustrating a step of filling the reservoir according to the second embodiment of the method.

Then, with reference to FIGS. 6 and 7, the steps of filling the deformable chamber 45 and the head 2 may be performed independently. The filling pipe 50 of the deformable chamber 45 does not pass through the reservoir. The installation may be arranged to move the head and the reservoir alternately to the same filling station or else to comprise two filling stations (or a filling station with 2 outlets, one outlet connected to the pipe 50 and one connected to the pipe 60), a first station for filling the head, more specifically at least part of the deformable chamber 45 through the filling valve 4, and a second station for filling the reservoir 3. The steps of filling the deformable chamber 45 and the head 2 may preferably be performed in the same filling step, and the conveying system of the installation 10 may be provided with conveying buckets 35 comprising at least two laying means, more specifically at least two cavities 36 in order to receive the head 2 and the reservoir 3.

The method comprises, before the closing step, a "rotation" step in which the head and/or the reservoir is rotated so as to assemble the head and the reservoir. The method comprises a step of rotating the deformable chamber relative to the reservoir before assembling the deformable chamber and the reservoir. Preferably, only the deformable chamber (therefore head 2) rotates around 180° before assembly with the reservoir.

Figure 8:
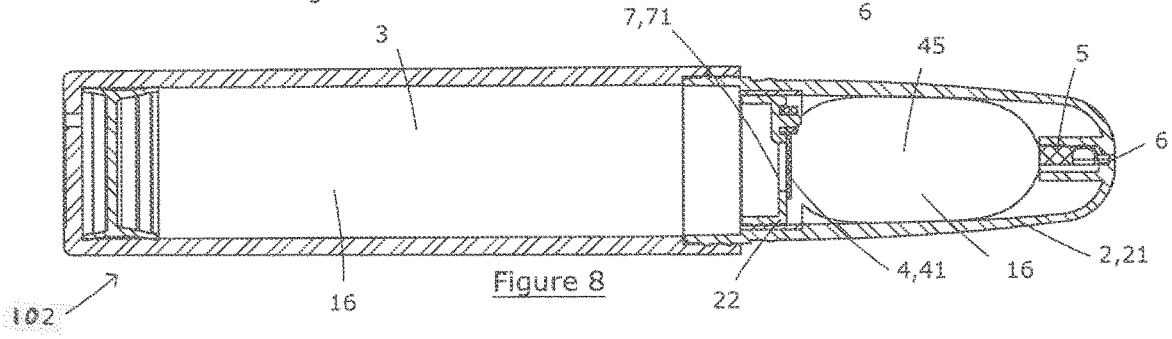
FIG. 8 is a side sectional view illustrating a closing step according to the second embodiment of the method.

Then, with reference to FIG. 8, this second embodiment comprises an assembly of the deformable chamber 45 and of the reservoir 3 so as to form the device 102 and implementing the step of providing the device 102. The closing step is carried out during the assembly of the deformable chamber 45 and of the reservoir 3, more exactly by stopping up the opening 8 by the head 2, for example by snapping or screwing.

In another mode of the manufacturing method, before the step of filling the deformable chamber 45, a suction is created from the feed orifice making it possible to withdraw gas from the deformable chamber, and then the filling needle injects the product into the deformable chamber. Preferably during this operation the needle is connected in a sealed manner to the feed orifice.

The method according to the invention may further comprise an additional step of placing the deformable chamber 45 under evacuation (in which a depression is created with respect to the outside), and a closing step in order to bring additional product into the deformable chamber 45 from the reservoir 3.

In this evacuation step, the outlet 6 of the head 2 may be stopped up by a preferably flexible element placed on the valve module or in the outlet orifice and compressed by a cap (not shown) covering the head 2.

In addition, in a variant of the embodiments, the deformable movable wall 13 may be replaced by a movable wall such as a rigid piston connected to an actuation button arranged to move this piston so as to vary the volume of the chamber 45.

Figure 10:
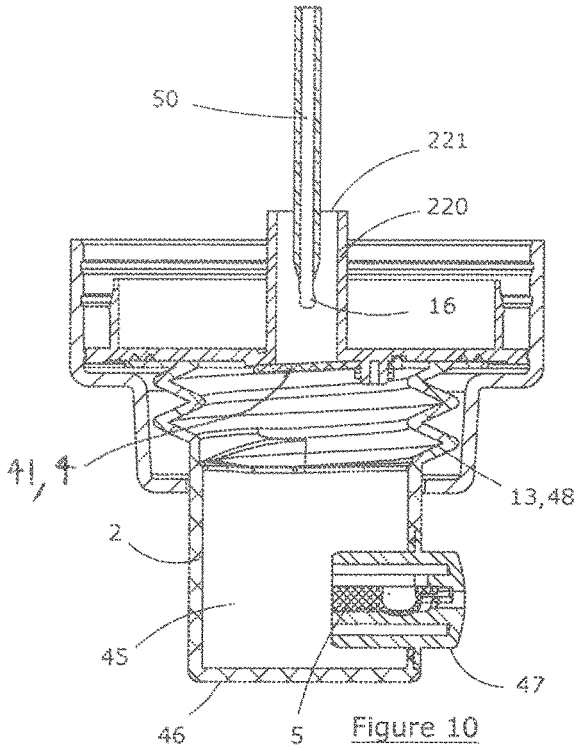
FIG. 10 illustrates a variant of the device 102.
Figure 11:
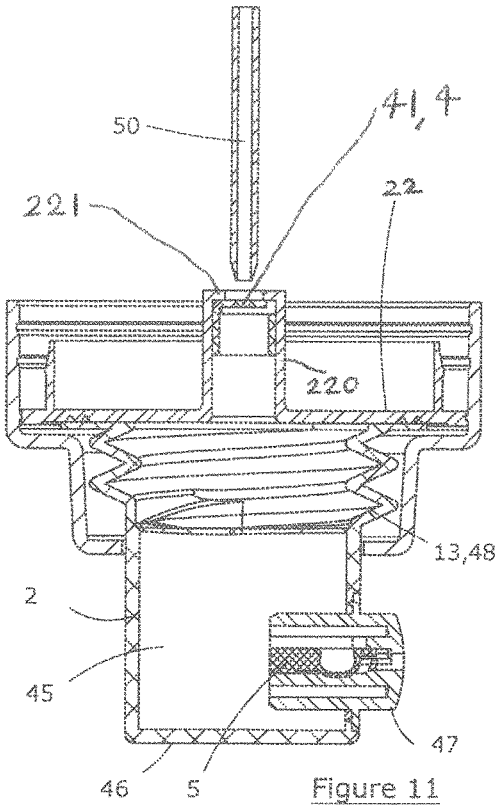
FIG. 11 illustrates another variant of the device 102.
Figure 12:
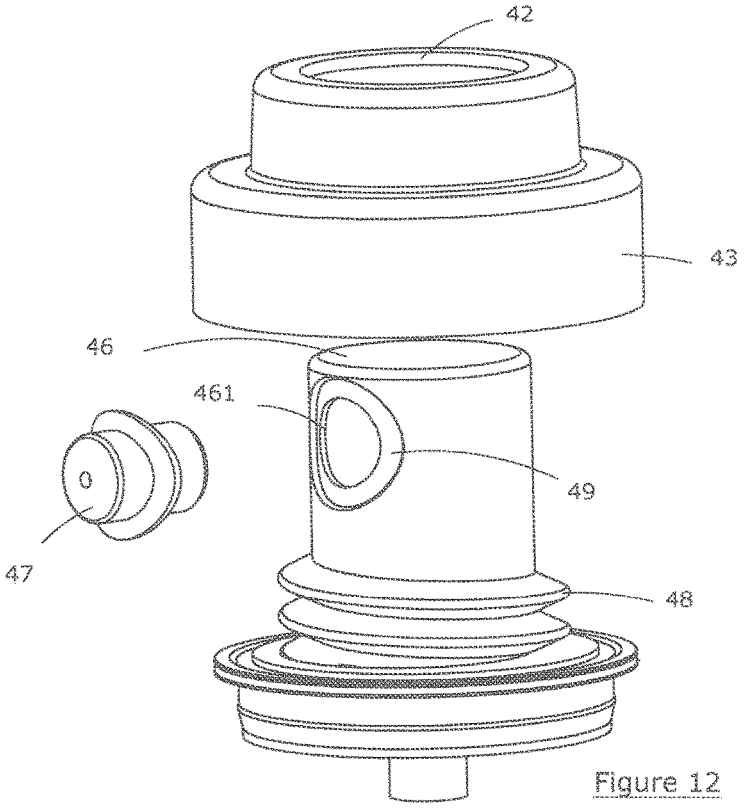
FIG. 12 illustrates an assembly of different elements of the variants of FIG. 10 or 11.

Next described, with reference to FIGS. 10 to 12, are different variants of the device 102 (previously described with reference to FIGS. 4 to 8), and to which the manufacturing method described above applies.

The description of these variants of device 102 and associated manufacturing method will be given only for their differences from the previous description.

In these variants, the head 2 comprises a pressing surface 46 of the wall 13.

The wall 13 comprises a bellows 48 in the form of a helix. This makes it possible to facilitate the demolding of the wall 13 during its manufacture.

Apart from the bellows 48, the interior surface of the chamber 45 is cylindrical (for its release from the mold).

The dispensing valve 5 is integrated inside a module 47 initially separated from the rest of the head 2.

The device 102 comprises a channel 220 which emerges from the stopper 22 (which forms a bottom wall) in the direction of the reservoir 3.

This channel 220 has two ends including:

an end 221 which opens into the reservoir 3 and is arranged to be immersed in the product 16, and another end leading to chamber 45.

Depending on the variant considered:

the end 221 is equipped with the filling valve 41 (as illustrated in FIG. 11) which is also the inlet valve 4, or the other end of the channel 220 is equipped with the filling valve 41 (as illustrated in FIG. 10) which is also the inlet valve 4.

Thus, depending on the variant considered:

chamber 45 comprises channel 221 for the filling step (FIG. 11), or the reservoir 3 contains (after assembly) the channel 221 for the filling step (FIG. 10).

For these variants, the previously described manufacturing method applies but differs only with respect to the following differences.

The filling step comprises at least partial filling (for example a drop) of product 16 or of a priming product, preferably within the channel 221, so that the product 16 or priming product is in contact with the filling valve 41 (which is also the inlet valve 4), at least at the level of the seat of the valve 41/4, from the side of the reservoir 3 (in the case of FIG. 10 or 11) and/or from the side of the deformable chamber 45 (in the case of FIG. 10 or 11, this necessitating a displacement or an opening of the valve 41/4, typically by the pipe 50).

In the case of the use of the priming product:

the priming product is typically a gel or an oil, a liquid (different from product 16 which is filled in the reservoir 3), such as a carbomer or hydrophilic synthetic polymer of acrylic acid, and/or the filling comprises the deposit of priming product as described above, and may optionally further comprise the filling from the reservoir 3 by the product 16 (with air or another gas which may be present between the priming product in contact with the valve 4/41 and the product 16 in the reservoir 3).

Thus in this case, the filling step is a step of at least partial filling of priming product, so that the priming product is in contact with the filling valve 41 (from the side of the reservoir 3 and/or from the side of the deformable chamber 45), and so that the priming product comprises a gel or a liquid (preferably in the channel 221) between the movable membrane of the feed valve 4 (which is also the filling valve 41 in this example) and the seat of the feed valve 4 (which is also the seat of the filling valve 41 in this case) while the chamber 45 is at least partially filled with gas or only gas.

Referring to FIG. 12, in the case of the variant of FIG. 10 as well the variant of FIG. 11, the manufacturing method further comprises:

a step of assembling the deformable chamber 45 to a ring 43 (the bottom wall 22 (or stopper 22) being assembled to the chamber 45 before or after the ring 43, passing the deformable chamber 45 through the interior of the ring 43 (more exactly via an orifice 42 of the ring 43), so that the ring 43 surrounds the chamber 45 while leaving an insertion orifice 461 accessible, then a step of assembling the dispensing valve 5 to the deformable chamber 45 by inserting, preferably without passing through the ring 43, the valve 5 alone and/or of the module 47 comprising the dispensing valve 5. This insertion is carried out by inserting the valve 5 alone and/or the module 47 in the orifice 461. The module 47 is preferably fixed (preferably by ultrasound) to the head 2 on a weld zone 49 surrounding the hole 461.

The ring 43 may be circular or square or the like.

Once the chamber 45 and the wall 22 (or stopper 22) are thus assembled (before or after assembly of the valve 5 and/or of the module 47), the manufacturing method comprises a step of assembling the deformable chamber 45 on the reservoir 3 by the ring 43 so that the ring 43 is fixed on the reservoir 3 while exerting a holding force of the chamber 45 and/or of the wall 22 on the reservoir 3.

Typically, the ring 43 maintains the bottom wall 22 and/or the chamber 45 in position in the ring 43.

Typically, the ring 43 is screwed or clipped onto the reservoir 3.

In addition, in each of the embodiments or variants described above, the filling valve 41 (and/or an additional filling valve) is arranged on the head 2 (for example on the wall 46) and/or on the chamber 45, so that the inside of the deformable chamber 45 is separated from the outside by the filling valve 41 (and/or respectively by the additional filling valve).

Of course, the invention is not limited to the examples which have just been described and numerous modifications may be made to these examples without departing from the scope of the invention.

The invention claimed is:

1. A method for manufacturing a device for dispensing a product, comprising:

providing a device having a reservoir, said reservoir being connected to a deformable chamber and being provided with a filling opening, an inside of the deformable chamber being delimited at least in part by a movable wall of which displacement causes a variation of the volume of the deformable chamber and:

the deformable chamber being separated from the reservoir at least by a feed valve, and/or being separated from an outlet of the device at least by a dispensing valve, and the deformable chamber being separated from the reservoir or from the outside by a filling valve and, providing a filling pipe and with the filling pipe, performing a step of filling at least part of the deformable chamber with product through the filling valve, and performing a closing step in which the filling opening is closed.

2. The method according to claim 1, wherein the filling valve is placed between the reservoir and the deformable chamber.

3. The method according to claim 2, wherein the filling valve is merged with the feed valve.

4. The method according to claim 1, comprising including means for moving at least part of the filling valve towards an interior of the deformable chamber to open the deformable chamber.

5. The method according to claim 1, where during the filling, gas initially inside the deformable chamber exits the deformable chamber through the filling opening.

6. The method according to claim 1, wherein the filling pipe is arranged to enter inside the deformable chamber, and the method further comprises using the filling pipe of the chamber to open the filling valve and filling the chamber at least partially with the product.

7. The method according to claim 6, wherein the filling valve is opened by direct pressure.

8. The method according to claim 1, comprising an additional step of evacuating the deformable chamber, and then performing a step of closing the reservoir to bring additional product into the deformable chamber from the reservoir.

9. The method according to claim 1, wherein the filling pipe of the chamber is arranged to open the filling valve, and fill the chamber at least partially with the product.

* * * * *